US006997198B1

(12) United States Patent
Holtkamp

(10) Patent No.: US 6,997,198 B1
(45) Date of Patent: Feb. 14, 2006

(54) TENT CONSTRUCTION AND METHOD FOR MANUFACTURING THIS TENT CONSTRUCTION

(76) Inventor: Egbert Berend Holtkamp, Hoofdstraat 9, Ter Apel (NL) 9561 JA ( * ) Notice: Subject to any disclaimer, the term of this patent is extended or adjusted under 35 U.S.C. 154(b) by 0 days.

(21) Appl. No.: 09/720,268

(22) PCT Filed: Jul. 12, 1999

(86) PCT No.: PCT/NL99/00444

§ 371 (c)(1),
(2), (4) Date: Apr. 23, 2001

(87) PCT Pub. No.: WO00/03107

PCT Pub. Date: Jan. 20, 2000

(30) Foreign Application Priority Data

Jul. 10, 1998 (NL) ..... 1009617

(51) Int. Cl.
*E04H 15/14* (2006.01)

(52) U.S. Cl. ..... 135/93; 135/97; 135/115; 135/117; 296/136.01; 52/83

(58) Field of Classification Search ..... 135/93–94, 135/97, 115–119, 120.4, 88.09, 88.18; 52/3–4, 52/63, 83, 222; 150/166, 168; 296/136, 296/100.18, 136.01, 136.18; 206/335
See application file for complete search history.

(56) References Cited

U.S. PATENT DOCUMENTS 884,948 A 4/1908 Orr
1,820,412 A * 8/1931 Warren ..... 135/119
1,833,095 A * 11/1931 Smith ..... 135/119
2,527,729 A * 10/1950 Hoff ..... 135/115
3,332,177 A 7/1967 Sepp ..... 52/2
3,598,133 A * 8/1971 Abert et al. ..... 135/94
3,670,747 A 6/1972 Pohl et al. ..... 135/1
3,765,134 A * 10/1973 Gilchrist ..... 47/17
3,896,830 A * 7/1975 Sharick ..... 135/116
3,970,096 A * 7/1976 Nicolai ..... 135/115
4,068,404 A * 1/1978 Sheldon ..... 135/120.1
4,719,935 A * 1/1988 Gustafson ..... 135/124
5,107,881 A * 4/1992 Feldman et al. ..... 135/124
5,765,584 A 6/1998 Heisler et al. ..... 135/93
5,778,613 A * 7/1998 Thomson ..... 135/115
5,915,399 A * 6/1999 Yang ..... 135/119

FOREIGN PATENT DOCUMENTS

DE 2459590 7/1976
GB 2121850 * 1/1984 ..... 135/115
GB 2258666 A 2/1993

* cited by examiner

*Primary Examiner*—Winnie Yip

(74) *Attorney, Agent, or Firm*—Jacobson Holman PLLC

(57) ABSTRACT

Method for manufacturing a tent construction having at least one panel manufactured from suitable cloth, and tent construction manufactured utilizing the method. A basic panel is manufactured from a material of desired properties and is provided with one or more covering panels or waterproof material that form part of the outer wall of the tent construction. The basic panel may consist of relatively narrow edges of durable material or of an entirely or partially closed panel of open, breathing material.

8 Claims, 1 Drawing Sheet

TENT CONSTRUCTION AND METHOD FOR MANUFACTURING THIS TENT CONSTRUCTION

FIELD OF THE INVENTION

The invention relates to a method for manufacturing a tent construction and to a tent construction manufactured according to the method. Within the framework of this specification, a "tent" or "tent construction" is meant to include any construction having one or more walls, including the roof, which are manufactured from tent cloth. Some of the many possible examples are camping tents, folding trailer tents, front tents, party tents, circus tents, stalls, protective covers, working tents, roofs, awnings, etc.

BACKGROUND OF THE INVENTION

A problem is that due to a new European legislation in respect of anti-fungal and water-repellent agents for tent cloth (PCP, inter alia, is prohibited or will be so before long, while the cloth that is treated with heavy metals must be taken back by the manufacturer or supplier at the end of this service life), tent cloth from cotton or mixed fiber, such as cotton/polyester, becomes mildewed very quickly. As a consequence, under unfavorable conditions, a folding trailer tent cannot remain folded-in for more than 12 hours, which is an unacceptably short time. Also, with a folding trailer tent, it is no longer possible to camp for a longer time during rainy weather conditions, because the cloth will then be affected by fungi.

Because of these problems, the lifetime of tents manufactured from cotton cloth or cloth from mixed fiber becomes unacceptably short, especially in view of the relatively high purchase price. For environmental reasons, this is therefore an objectionable matter, since in spite of the fact that less toxic substances are used because of the new legislation, the substances remain toxic all the same, from an environmental viewpoint. In view of the (unduly) short lifetime, the tents have to be replaced more often than necessary.

The above problem of a short lifetime due to fungoid growth and fouling can be overcome by using cloth manufactured from synthetic material, such as waterproof polyester cloth or a cloth manufactured from other suitable synthetic fibers, or a plasticized cloth. However, a drawback of such type of cloth is that it does not breathe. As a consequence, condensation occurs on the inside of the tent construction. This also holds for a new type of cotton cloth which has recently become available and which is treated in such a manner that it does not become mildewed quickly and is fire-resistant, but which does not breathe sufficiently, if at all.

Another problem that presents itself in particular in roofs of tent constructions and in particular, but certainly not exclusively, in roofs of front tents of caravans, is that these tent roofs are fouled relatively quickly by sticky drops, such as resin, falling from trees, and by bird droppings. Cleaning of such tent roofs is hardly possible. In practice, it often turns out that front tents of caravans have to be replaced after two years already, due to the fouling of mainly the roof that has occurred in that period.

SUMMARY OF THE INVENTION

The object of the invention is to overcome the drawbacks and problems outlined and generally to provide a durable and efficient tent construction and method for the manufacture thereof. Another object of the invention is to provide a tent construction and a method for the manufacture thereof that offers very good ventilation possibilities and in which condensation is prevented.

In accordance with the invention, a method for manufacturing a tent construction comprising at least one panel manufactured from suitable cloth is characterized by the steps of manufacturing a basic tent construction having at least one basic panel from a desired material and providing at least one of the basic panels with one or more covering panels which form part of the outer wall of the tent and which are attached so as to be at least partially detachable.

A tent construction according to the invention is characterized by a basic tent construction comprising at least one basic panel, at least one of the basic panels being covered with one or more covering panels of waterproof material which form part of the outer wall of the tent construction. In accordance with another aspect of the invention, at least one covering panel is attached so as to be at least partially detachable.

It is observed that U.S. Pat. No. 5,765,584 discloses a tent whose door is provided with a portion manufactured from gauze, which is in turn provided with a partially detachable covering panel. This known covering panel is manufactured from waterproof material, yet is located on the inside of the gauze panel and hence on the inside of the tent. The known covering panel, provided on the inside, can partially be unzipped for enabling opening a ventilation opening from the inner space of the tent. Hence, the known panel does not protect a possibly vulnerable inner panel. Also, in the closed position, the known panel does not prevent condensation on the inside.

BRIEF DESCRIPTION OF THE DRAWINGS

Hereinafter, the invention will be further described with reference to the accompanying drawing of some exemplary embodiments.

DETAILED DESCRIPTION OF THE PREFERRED EMBODIMENTS

Figure 1:
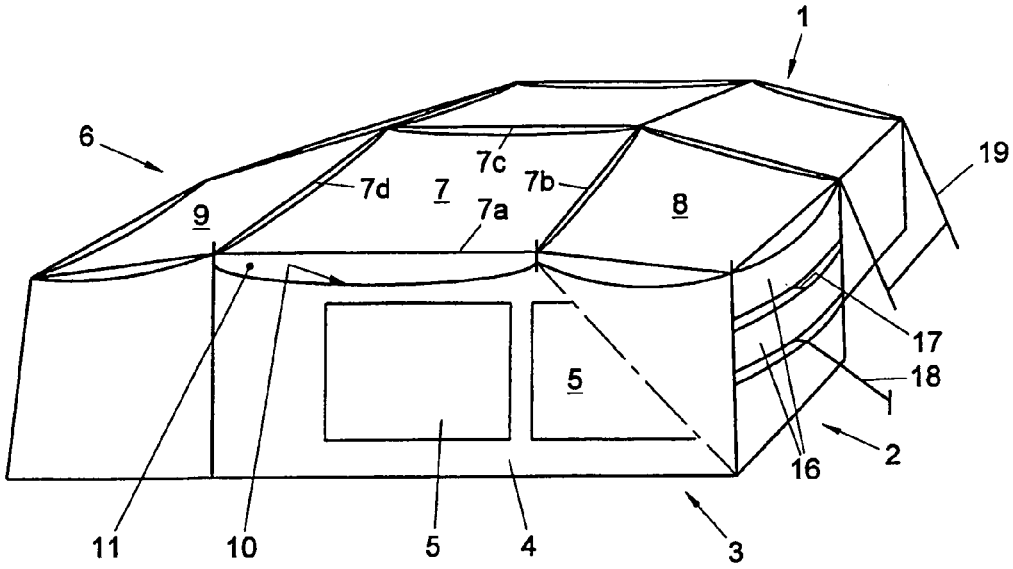
FIG. 1 schematically shows, in perspective, an example of a practical application of the invention with a folding trailer provided with a front tent.

FIG. 1 schematically shows an example of a folding trailer tent 1 provided with a front tent 2.

A folding trailer tent can be made from 100% synthetic cloth products having a very long lifetime, but which, however, have the drawbacks of condensation and the lack of "breathing capacity". In accordance with a first aspect of the invention, a "skeleton" for at least a part of a tent comparable with a timbered house can be made from synthetic material. However, one or more large faces (roof and sidewall faces) of the tent are "filled in" with exchangeable cloth panels. FIG. 1 shows a front wall 3 of a front tent, constructed according to this principle. The wall 3 comprises strips 4 of firm cloth, which form the skeleton of the wall 3, as well as exchangeable panels 5. By means of zippers or VELCRO hook and loop fasteners or other techniques, these panels are attached to the "timbered frame/skeleton" along their circumferential edges. The number and dimensions of the panels can be optional. A small number of large panels, or a larger number of small panels. After many years of use, the exchangeable panels can be replaced as and when required. These panels can be produced in stock, in cotton cloth as well as in synthetic materials. At the moment of purchase and thereafter, the user of the tent can decide for himself which panels have to be supplied in synthetic cloth, and which panels in cotton cloth. The choice can partly be motivated by the intended use. If the tent, folding trailer or front tent is predominantly used for camping "on the hike", or, conversely, for a fixed stand, this may determine the composition of the panels. Also, in this manner, allowances can be made for personal preference. One of the objects of the invention is to offer the possibility of minimizing the number of fixed panels of cloth of a relatively short lifetime. In addition, the tent no longer has to be thrown away when a particular panel of cotton cloth has become moldy, fouled or leaky. The tent including the "timbered frame", the "framework" with all its complicated angular joints, fastening points, reinforcements, etc. is produced once, for a long time, and the "fill-in" panels can be purchased or replaced as and when required. The effect that the tent is discarded due to fouling or because its color is no longer modern can hereby be avoided. This is an advantage to the environment. It is also possible to fit, per panel opening, two or more, if necessary overlapping panels in a simple manner by zippers, VELCRO hook and loop fasteners, etc. If so desired, the panels can partially be of rollable or erectable design, to promote the admission of light and air. Hence, the framework of the tent can comprise edges or strips supported by tent poles and the like, which edges or strips are manufactured from highly durable cloth and whereto or whereon panels are fitted that are relatively easy to attach and replace. According to a modification of the above-described tent construction, it is possible to use a number of exchangeable panels which are not, or not all of them, mounted on a separate skeleton, but which are directly detachably connected to adjoining panels via zippers, VELCRO hook and hoop fasteners or the like.

FIG. 1 schematically shows an example of such construction, used for the roof 6 of the front tent. In the example shown, the roof comprises a central section 7 and two side sections 8 and 9. One or more of the sections 7–9 may be detachably connected to the adjoining section(s) and/or adjoining walls, allowing these detachable sections, when for instance fouled, to be detached and cleaned. In practice, the cleaning of a roof panel of a tent construction, such as for instance a front tent of a folding caravan, is hardly possible if the roof panel is not detachable. Further, when fouled seriously, such panel can readily be replaced. If, for instance, the central section 7 is separately replaceable, zippers or VELCRO hook and loop fasteners may be provided along the edges 7*a*, 7*b*, 7*c* and 7*d*. Of course, the roof may also be detachable and replaceable as a whole, whether or not in combination with separately detachable roof sections.

Preferably, the roof of the tent is of double design, with an inner roof and an outer roof, the outer roof having at least one outer roof panel and the inner roof having at least one inner panel located under the outer panel having a gap formed between the inner and outer panels. In that case, the outer roof may be connected along one or more edges to the inner roof by operable fasteners such as, for instance, zippers 25, 26 or VELCRO hook and loop fasteners or the like. The inner roof may then again be detachably or undetachably connected to a tent skeleton as described hereinabove, or be directly connected, also detachably or undetachably, to adjoining roof panels and/or wall panels.

A major advantage of such construction is that by entirely or partially undoing, on two directly or obliquely opposite or adjoining edges, zippers or VELCRO hook and loop fasteners or the like, whereby the outer roof is connected to the inner roof, a perfect ventilation possibility is created. In the example shown in FIG. 1, for instance, the zippers of the roof section 7 have been opened along the edges 7*a* and 7*c*, to create an open gap 11 between inner roof section 10 and outer roof section 7. Through the gap, air can flow that may provide cooling when the weather is hot and that may also provide ventilation in the tent when the inner roof is at least manufactured from air-permeable material. By opening only one zipper, for instance on the wind side, forced air is blown into the tent via the gap 11. Conversely, when the zipper on the lee side is opened, air is drawn from the tent.

However, also if no wind is involved, a ventilating air circulation can be created by opening one or more zippers entirely or partially, in that hot air located between the inner roof and the outer roof can then flow away, whereupon air present in the tent can flow through.

To effect that, if necessary, the gap 11 between inner roof and outer roof actually remains open, the outer roof is preferably provided with a tensioning mechanism for pulling the outer roof taut, at least tauter than the inner roof. For this purpose, the outer roof can for instance be readily provided with two or more juxtaposed openings for tent poles, where normally only one opening is present. By using the suitable opening, the roof can be pulled tauter or, by contrast, less taut.

Figure 3:
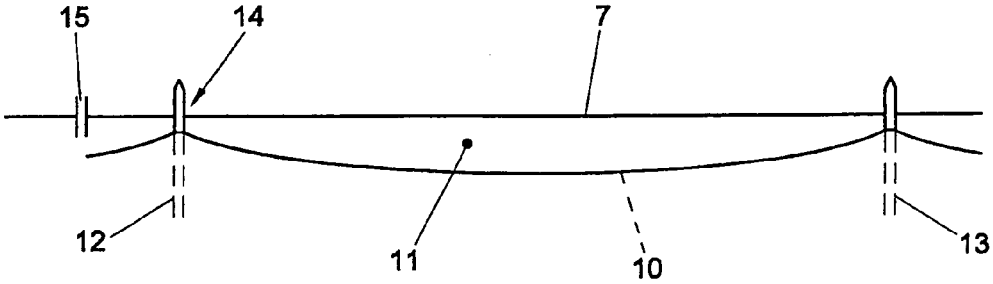
FIG. 3 shows a detail of a tent construction according to the invention.

The above arrangement is shown schematically in FIG. 3. FIG. 3 shows two tent poles 12,13 and an inner roof panel 10 supported thereby. Located above the inner roof panel is an outer roof panel 7, which, in this example, has two openings 14,15 at the location of tent pole 12. The opening 14 is closest to the other tent pole 13 and is used, in this example, for attaching the panel 7 to the tent pole 12, causing the panel 7 to be tautened. If the opening 15 farther from the tent pole 13 is used, the panel 7 is tensioned less taut and the gap 11 between the pieces 7 and 10 is reduced or disappears.

Advantageously, the inner roof panel can be cut hollow, which promotes the formation of an effective ventilation gap 11.

To prevent raining in, the outer roof panel may be provided with edge flaps 28 capable of covering the gap 11 in depending condition. The edge flaps can for instance be secured on the adjoining wall by zippers, press studs, loops, hooks, VELCRO hook and hoop fasteners, etc., or be folded over upwards.

Also, the inner roof panel may have waterproof edge strips 29 along the circumferential edges.

Alternatively, the tent, for instance a camping tent, folding trailer tent, caravan and motorhome front tent may be constructed from a fairly "open", like bandage gauze, air-permeable, synthetic woven fabric, for instance from very strong polyester or aramide, etc, or similar yarns. Such a tent can last a generation. The tent can be covered per panel by thin fabrics of cotton, nylon, synthetic cloth, plastic, polyethylene, etc. The type and choice of material per panel can again be filled in individually and according to need and use. An advantage of this method is also that the various panels can remain attached to the supporting fabric by one edge thereof, while the other edges can be attached by a zipper or the like, which enables the panels to be unzipped and stretched out as desired. In this manner, an almost steplessly controllable ventilation is realized in the tent, whereby the tent can also be optimally ventilated, much better than is usual in the present-day tent technique, during rain where water is discharged, air can enter the tent underneath the panels, via the air-permeable basic/supporting fabric and during periods of heat. By the stretched-out panels, also roof panels, as for instance shown at 19, like sun screens, the sun is kept out of the tent, while the ventilation can be distributed over almost the entire surface of the tent. Since this supporting fabric can be of a high quality with an enormous resistance to tearing, the safety from vandalism and crime and the lifetime of the tent has been increased compared with the present-day tents. All advantages of the first-mentioned construction with exchangeable panels apply here as well.

A particular advantage of a double-walled construction of the panels is that also when the outer panels are closed, for instance in the case of rainy weather, condensation is prevented by the insulating action of the layer of air between inner and outer panels and also by the fibrous structure of the inner panels.

These effects, i.e. the insulating action and the prevention of condensation, also occur if an inner panel and an outer panel are fixedly, hence not (partially) detachably, interconnected along their circumferential edges.

A third manner of embodying the finding is to construct the tent from a supporting fabric as desired for instance cotton for ventilation, strong synthetic fabrics for lifetime and strength, etc. or a combination of supporting fabrics such as cotton, polyester, etc. The covering panels, which may also be arranged in the manner of roof tiles or scales, can be connected to the basic fabric by, for instance, zippers, VELCRO hook and loop fasteners, stitching on one, two or three sides, or a combination thereof, or other connecting techniques. Such panels or "scales" are shown in FIG. 1 at 16, by way of example, and can preferably be pushed or pulled away from the tent from supporting fabric by means of "expanders" 17, or by stretching out by guy ropes, enabling air to permeate the supporting fabric underneath the panels. Along their lower edges, the scales can optionally be provided or not provided with fasteners for attachment to the supporting fabric or to the underlying scale. Optionally, openings or windows may be locally provided in the supporting fabric, behind the covering panels. If so desired, the covering panels can locally be transparent or have closable windows. Thus, it is possible to have a supporting tent of breathing material, such as for instance cotton, which, protected by the overlying panels, never becomes wet in the rain and which is not exposed to sunrays. The many advantages already pointed out in the above passages are largely also applicable to this finding.

A combination of all above-described techniques is possible.

A major advantage of a tent construction as described hereinabove is that condensation is even prevented during rainy weather. This renders the construction described highly suitable for being used for, for instance, protective covers for motorcars, boats, motorbikes, airplanes, helicopters, weapon material, excavators and other machines, garden furniture, etc. Other possible applications are the following:

parts of caravans or campers that are made of cloth; party and circus tents and tents for events; beach tents;

tents for accommodating workers permanently or not permanently, whether or not for special projects;

accommodations for animals in which tent cloth is used; storehouses in which cloth is used;

built-on tents for caravans and campers;

various types of awning, closable or not closable with sidewalls;

shed extensions, verandahs or sun porches; storage sheds with tent door and/or tent walls or portions thereof;

hothouses;

boat and motorcar covers the cloth or artificial leather portion which protects the boat or motorcar permanently from weather influences or which can be opened and closed;

working tents or roofs used for various purposes, for instance for road, soil, cabling and bridge works, excavations, shipyards, etc.;

boat houses made of cloth;

motorhomes and motorcar garages or roofs made of cloth;

tent houses or tent portions attached to houses;

truck coverings and tarpaulins;

market and sales stalls;

roofs of any nature, such as roofs for swimming pools or sandboxes; sun screens.

The tent construction according to the invention can also be used for, for instance, the removal of asbestos, by for instance putting up a closed-off tent which keeps the asbestos particles within the tent and keeps out the rain, while the air can enter all the same, utilizing filtering cloth for the underlying layers of cloth.

Conversely, tents, or parts of tents, protective covers, etc. as mentioned above, made as meant by the invention, can keep out harmful particles such as dust or pollen, while ventilation can nevertheless be effected in a sufficient manner.

With a tent according to the invention, allergic persons can camp also when the air contains much pollen, when the appropriate filtering cloth is used. For instance, during the night, the entire tent can be closed hermetically if required, an entirely closed tub ground sheet can be used and fresh air is let in through the filtering cloth.

Figure 2:
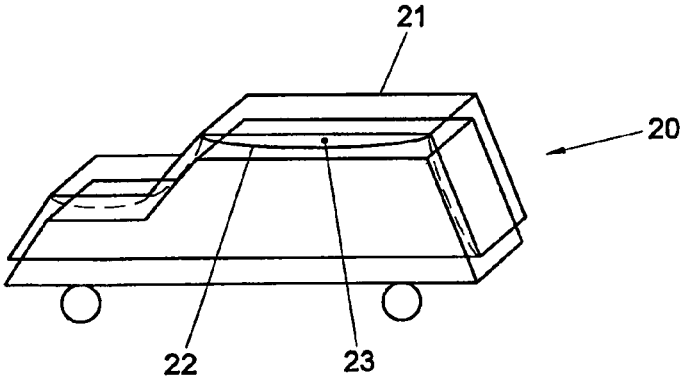
FIG. 2 schematically shows another application of the invention.
Figure 4:
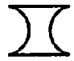
FIG. 4 shows a detail of FIG. 2 a spacer for placing between an outer layer of waterproof material and an inner layer of breathing material of a protective cover for the motorcar shown in FIG. 2.

An example of a protective cover for a motorcar which embodies the invention is shown schematically in FIG. 2. The cover 20 has an outer layer 21 of waterproof material and an inner layer 22 of breathing material. If required, spacer means may be provided between the two layers. For instance, hourglass-shaped spacer means of soft plastic may be used, securable with a few stitches or by means of glue. An example is shown schematically in FIG. 4. Condensation, which normally often occurs in such covers, can thus be avoided. Preferably, also in a protective cover according to the invention, the edge connection between an outer panel and an inner panel can be opened or closed by operating means to enable ventilation. In FIG. 2, the roof panel is open and the open space between inner panel and outer panel is indicated by 23.

In a tent construction according to the invention, the space between an outer and an inner panel, when the outer panel is entirely closed, contains a layer of substantially still air, which has a heat-insulating effect. This prevents condensation. Condensation is also prevented in that the inner panel is not manufactured from dense, smooth material. The insulating effect can even be improved by inserting between an outer panel and an inner panel, or underneath the "scales" if scales are used, a layer of insulating material.

If so desired, the outer panels and "scales" of a tent construction according to the invention can even be of a double-layered construction, so that between the two layers an insulating material, such as for instance blister padding, aluminum foil, blisterpadding with a layer of aluminum, etc., can be provided. The relevant panels can for instance be designed as a type of envelope, enabling ready insertion and removal of the insulating material.

It is observed that after the foregoing, various modifications will readily occur to anyone skilled in the art. Such modifications are understood to fall within the framework of the invention.

The invention claimed is:

1. A method for manufacturing a tent having at least one roof panel and at least one wall panel, the method comprising the steps of making at least a roof panel having an outer panel covering an inner panel, providing operable fasteners along edges of said outer panel and said inner panel to enable opening or closing an interspace located between the inner panel and the outer panel so that air may flow through said interspace for ventilation purposes, removably mounting the outer panel so that the outer panel is completely removable from the tent, and stretching the outer panel to increase the interspace between the outer panel and the inner panel.

2. The method according to claim 1, wherein at a location of at least one tent pole, the outer panel is provided with at least one additional opening for receiving a tent pole to enable bringing the outer panel into a taut condition.

3. The method according to claim 1, wherein the inner panel provides a hollow appearance.

4. A tent structure comprising a tent having at least one basic panel manufactured from air permeable tent cloth material, said at least one basic panel being covered with at least one covering panel of weather resistant material, forming part of an outer wall of the tent, and a gap-shaped interspace being formed between said at least one basic panel and said at least one covering panel, the covering panel being detachably mounted by detachable fasteners extending along at least one of the edges of said at least one covering panel for at least partial removal from the tent and for allowing air flow through said interspace, the detachable covering panels including at least a completely removably roof panel, and tensioning means for tensioning the roof panel.

5. The tent structure according to claim 4, wherein the tent has a number of basic panels, at least part of said basic panels is made of breathing cloth, and, on said tent, a number of covering panels of weather-resistant material are provided, said number of covering panels comprising one or more at least partially detachable covering panels.

6. The tent structure according to claim 4, wherein a gap-shaped interspace is opened or closed between an outer roof panel and an inner roof panel by detachable fasteners located along edges of said outer roof panel and said inner roof panel.

7. The tent structure according to claim 4, wherein the tensioning means comprise a number of receiving openings for a tent pole, provided side by side in the roof panel.

8. The tent structure according to claim 4, wherein a number of the covering panels have expanders for stretching out.

* * * * *